US005428957A

United States Patent [19]

Keates

[11] Patent Number: 5,428,957

[45] Date of Patent: Jul. 4, 1995

[54] EXHAUST STACK STOPPER

[76] Inventor: Richard L. Keates, 300 Devon La., West Chester, Pa. 19380

[21] Appl. No.: 209,415

[22] Filed: Mar. 11, 1994

Related U.S. Application Data

[63] Continuation-in-part of Ser. No. 50,538, Apr. 20, 1993, abandoned.

[51] Int. Cl.[6] ..... F01N 7/00

[52] U.S. Cl. ..... 60/324; 454/2; 454/94; 251/147

[58] Field of Search ..... 60/324, 322, 272; 73/116, 117, 117.3; 454/2, 94; 251/326, 147, 357; 137/351

[56] References Cited

U.S. PATENT DOCUMENTS

| | | | |
|---|---|---|---|
| 1,790,059 | 1/1931 | Nelson | 454/2 |
| 2,421,838 | 6/1947 | Harmon | 60/324 |
| 2,755,727 | 7/1956 | Shoberg | 454/94 |
| 3,331,391 | 7/1967 | Merdinyan | 251/357 |
| 3,473,462 | 10/1969 | Imming | 454/2 |
| 3,984,975 | 10/1976 | Price | 60/301 |
| 4,106,290 | 8/1978 | Johnson | 60/324 |
| 4,179,883 | 12/1979 | Nishiyama | 60/293 |
| 4,685,828 | 8/1987 | Whittle | 251/147 |
| 4,920,747 | 5/1990 | Haney | 60/324 |

*Primary Examiner*—Douglas Hart
*Attorney, Agent, or Firm*—H. Robinson Ertelt

[57] ABSTRACT

A device is disclosed for shutting off the flow of exhaust gases from the exhaust outlet of a diesel engine having a substantially vertical exhaust stack. The device is especially useful for stopping the flow from one of twin diesel stacks when a tractor or truck having twin stacks from a single manifold is undergoing maintenance in an indoor facility. The device permits an operator standing on the floor to position a resilient pad in sealing engagement with a stack outlet twelve feet or more above floor level and lock the pad into position and to remove the device, again from ground level, when maintenance has been completed and the engine shut down.

20 Claims, 9 Drawing Sheets

EXHAUST STACK STOPPER

This is a continuation-in-part of Ser. No. 08/050,538, filed Apr. 20, 1993, now abandoned.

This invention relates generally to improving air quality in the workplace, and more particularly to facilitating the removal of exhaust fumes from shops where diesel trucks and tractors are maintained.

In the trucking industry many diesel-powered vehicles are equipped with twin vertical exhaust stacks, one on the left side of the driver's cab and one on the right, with both leading from a single engine manifold. While this symmetrical arrangement may be more pleasing aesthetically, when the time comes for maintenance or overhaul it presents a problem. Typically each service bay for diesel vehicle maintenance is equipped with a single hose drop for carrying exhaust fumes to a duct system for transfer out of the building. For proper control of emissions, twin stack vehicles require duplication of the usual equipment—two exhaust canes, two nozzles, two flexible hoses, and two connectors to the duct system. This duplication of equipment is not always available or practicable, with the result that the twin stack vehicle may be fitted with only one exhaust removal arrangement in the vain hope that the pressure drop caused by the single removal system will remove substantially all of the exhaust fumes. The result, of course, is unacceptable levels of exhaust fumes being vented into the building.

The present invention provides a device that is capable of stopping the flow of exhaust fumes from one of the twin stacks so that all the engine emissions may be taken into a single exhaust removal system. The invention recognizes that there are different configurations of the outlet of exhaust stacks and provides for dealing with a variety of outlet arrangements. Essentially, the device provides a means for an operator standing on the floor of the maintenance facility to close off one of the twin stacks, even though the stack outlet may be twelve feet or more above floor level. Once fixed in place, the device remains in place, unattended, to be removed when the maintenance procedures have been completed and the engine shut down.

The device consists of a plate to which is affixed a heat-resistant, resilient pad, positioning means for holding the plate, and means for applying to the positioning means a downward force that holds the pad in sealing engagement with the exhaust stack outlet. The structure of the positioning means and the manner in which it holds the plate will vary with the conformation of the stack outlet, i.e., whether the plane of the outlet is horizontal, vertical, or at an angle. For example, the positioning means may be a yoke in which the plate can pivot or a frame holding the plate. In one embodiment the downward force will be applied to the positioning means by an appropriate weight, and the positioning means can be placed on top of the stack in any convenient manner, such as lowered from above or placed from the floor by means of the releasable clamp on a pole. In another embodiment the positioning means may be mounted on a support member, with the downward force applied to the support member. The height of the positioning means on the support member may be adjustable. Means are provided for adjusting the plane of the plate to be parallel to the plane of the exhaust stack outlet and locking it in that position. Also provided are means for aligning and maintaining the plate opposite to and in close proximity with the outlet, with the pad facing the outlet. When a support member adapted to place the device on the stack from the floor is used, on the lower portion of the support member may be mounted a yoke. (As used in describing the present invention, a yoke is roughly Y-shaped and consists of a U-shaped member and a stem. The cross section of the U-shaped member may be a smooth curve, such as a semicircle, or be made up of straight segments, such as a flattened U or a section of a polygon. The U-shaped member has a center portion, two end portions, a concave side, and a convex side. The stem has two ends, one attached to the center portion of convex side of the U-shaped member; the other end may be referred to as the free end.) In one use, the concave side of the yoke is designed to rest against the heat shield of the stack, or the lower portion of the stack if there is no heat shield, while the free end of the stem is adjustably mounted on the support member in such a way that the distance between the heat shield or stack and the support member may be adjusted and locked in place. The smaller diameter of an exhaust stack requires a yoke different in size from that used on a heat shield. The design of the device permits rapid replacement of a yoke of one size with a yoke of a different size. (It is understood that alternative configurations to yokes, having the same effect, may be substituted.) The downward force may be applied to the support member by means of a weight or by attachment to the heat shield or the tractor body by tensioning means.

These and other attributes of the present invention, and many of its attendant advantages, will become more readily apparent on consideration of the following description and the accompanying drawings of preferred embodiments, in which.

Figure 1:
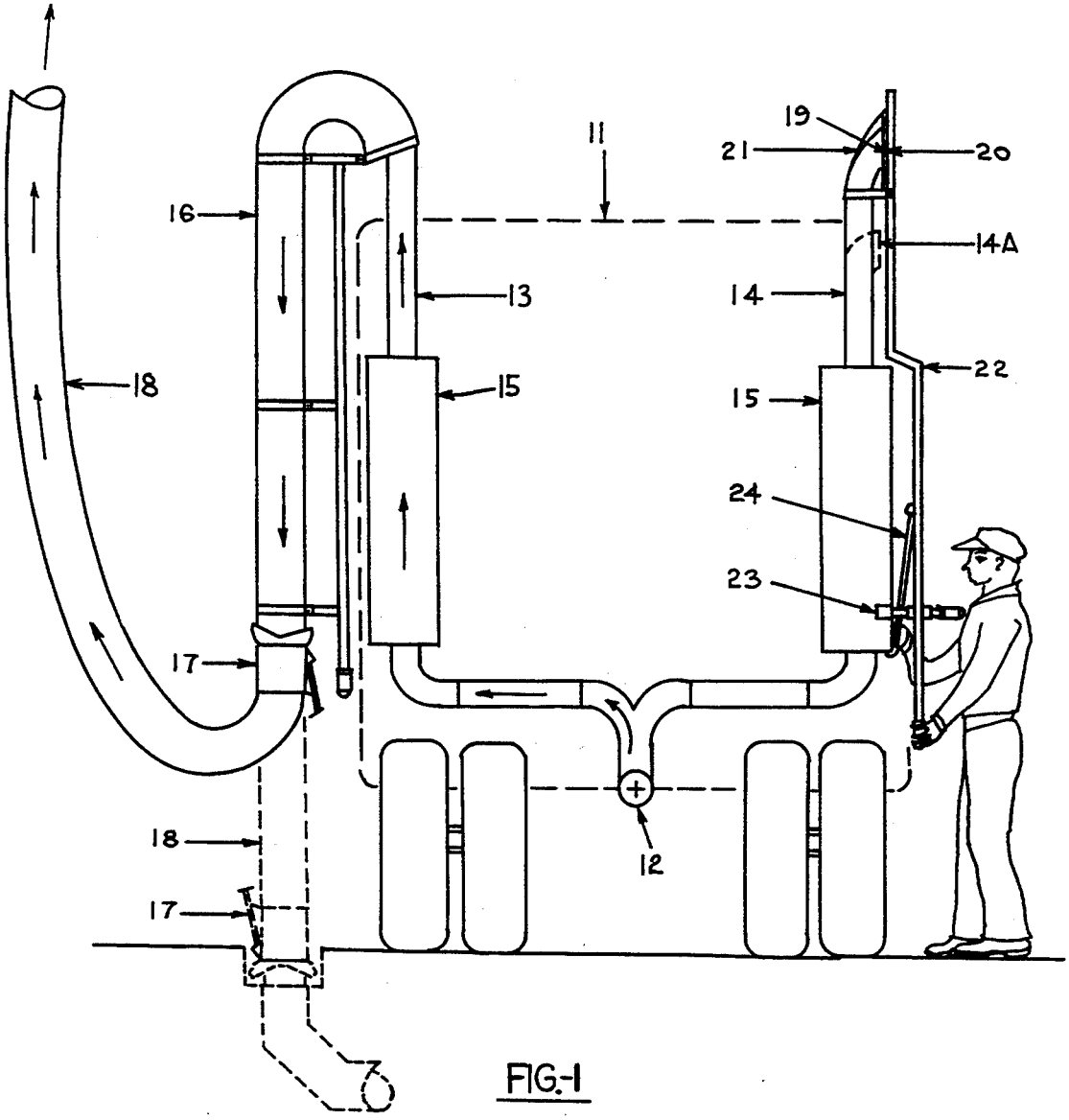
FIG. 1 is a pictorial view of a preferred embodiment of the invention in operation on a stack having a curved turn-out, showing a sectional view of a portion of a vehicle cab and its diesel engine manifold.
Figure 2:
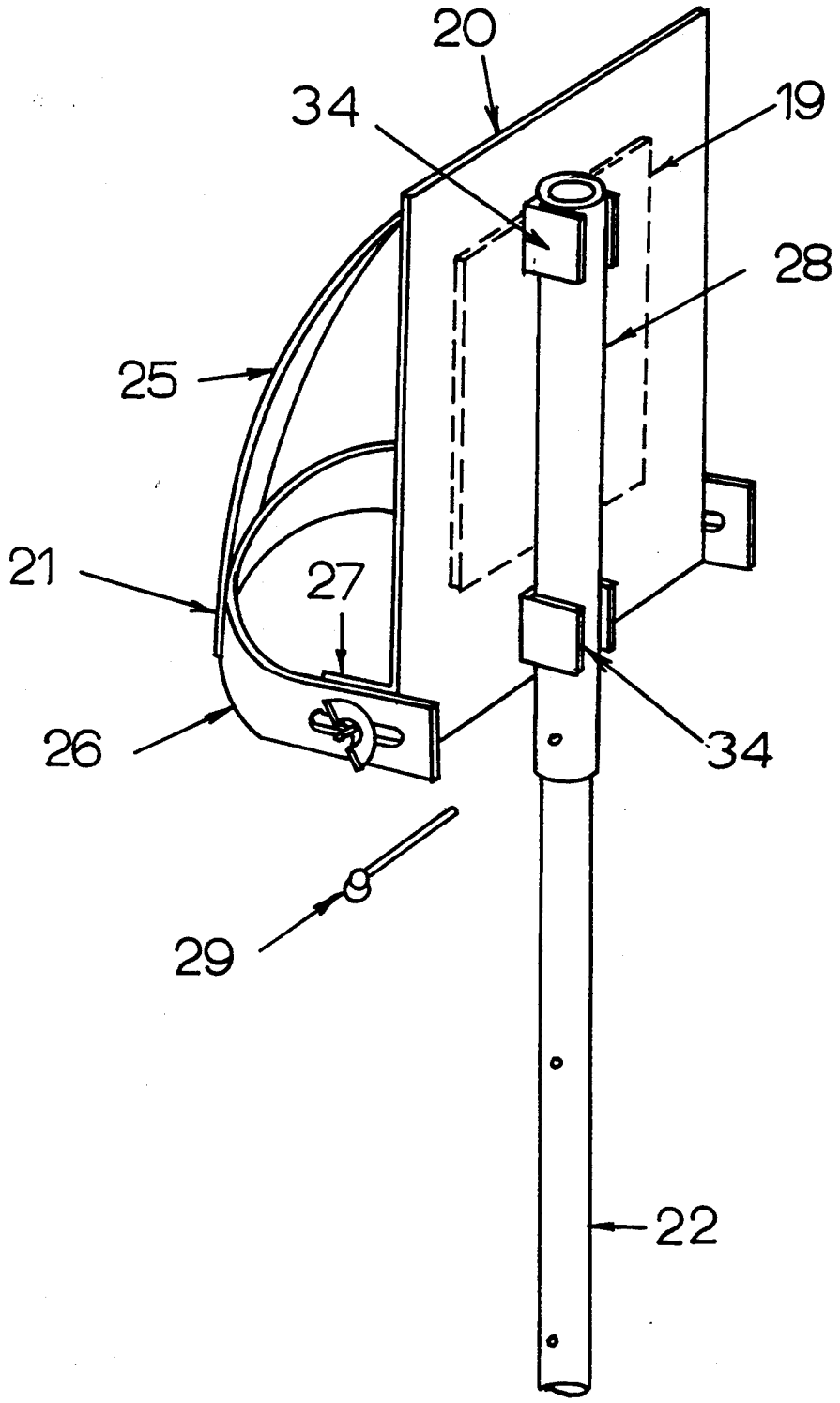
FIG. 2 is a pictorial view of the upper portion of a preferred embodiment showing adjustable guide means.
Figure 3:
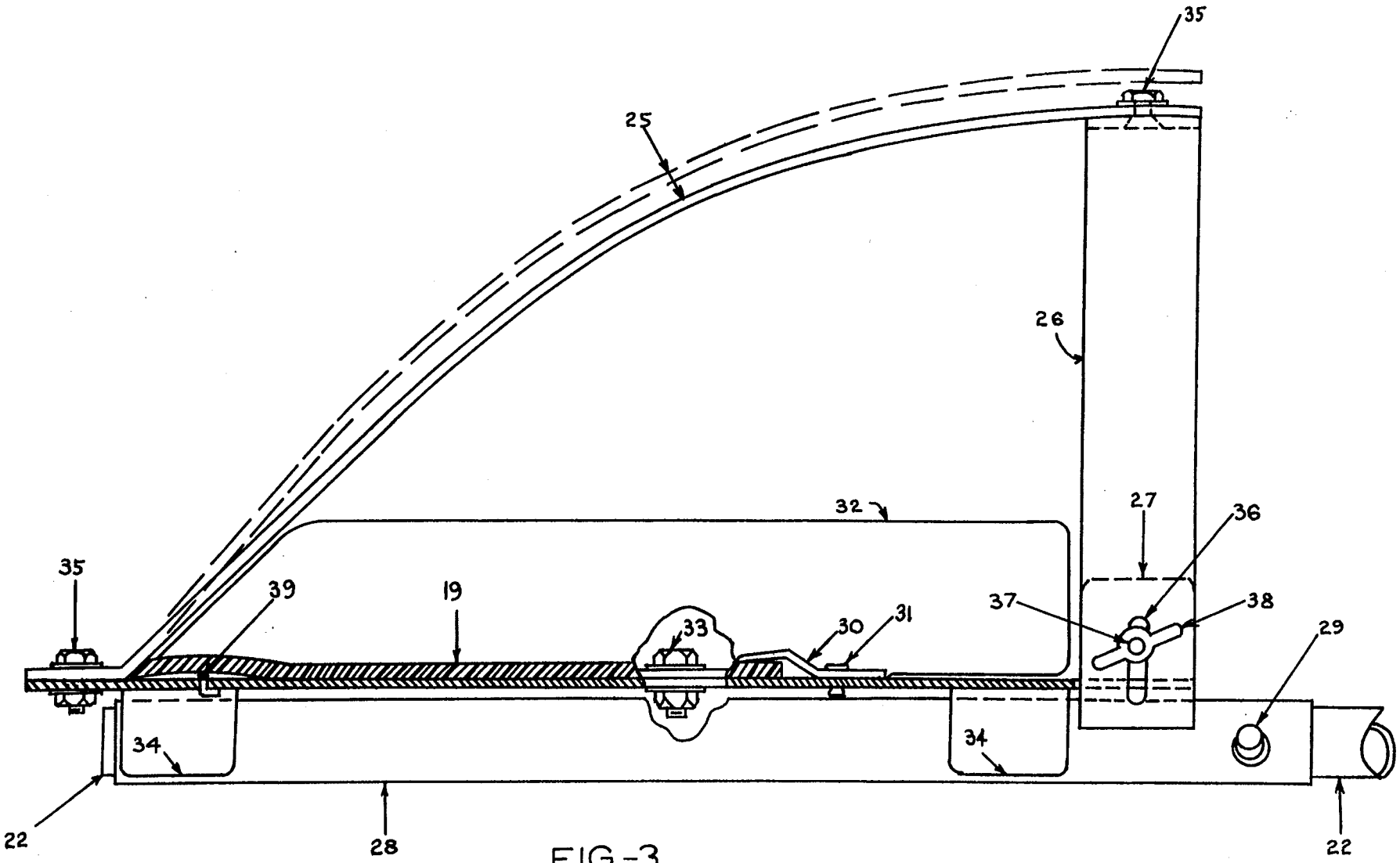
FIG. 3 is a side view of the preferred embodiment shown in FIG. 2, showing the plate and pad attached to the positioning guide means.
Figure 4:
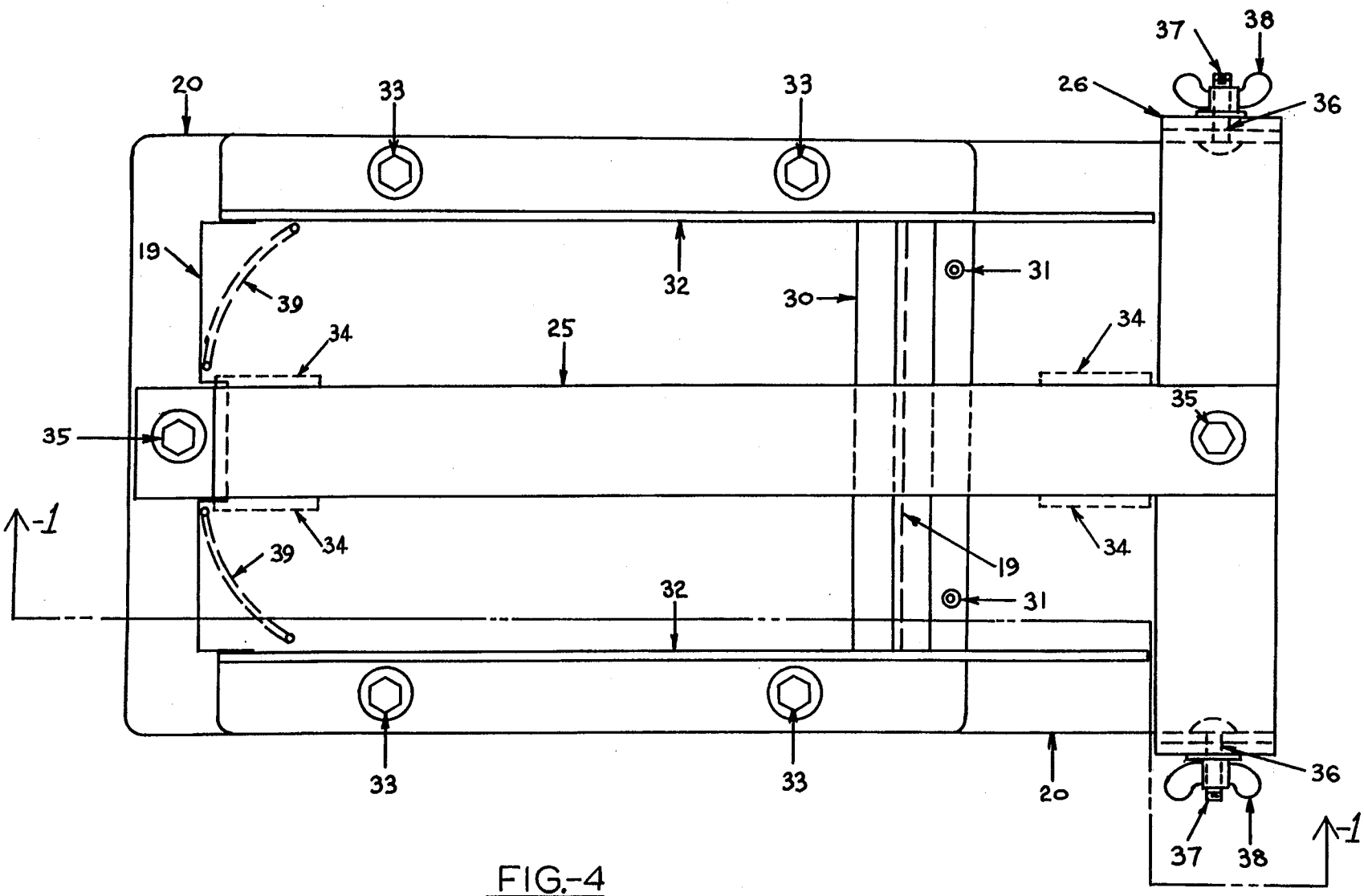
FIG. 4 is a plan view of the embodiment shown in FIG. 3.
Figure 5:
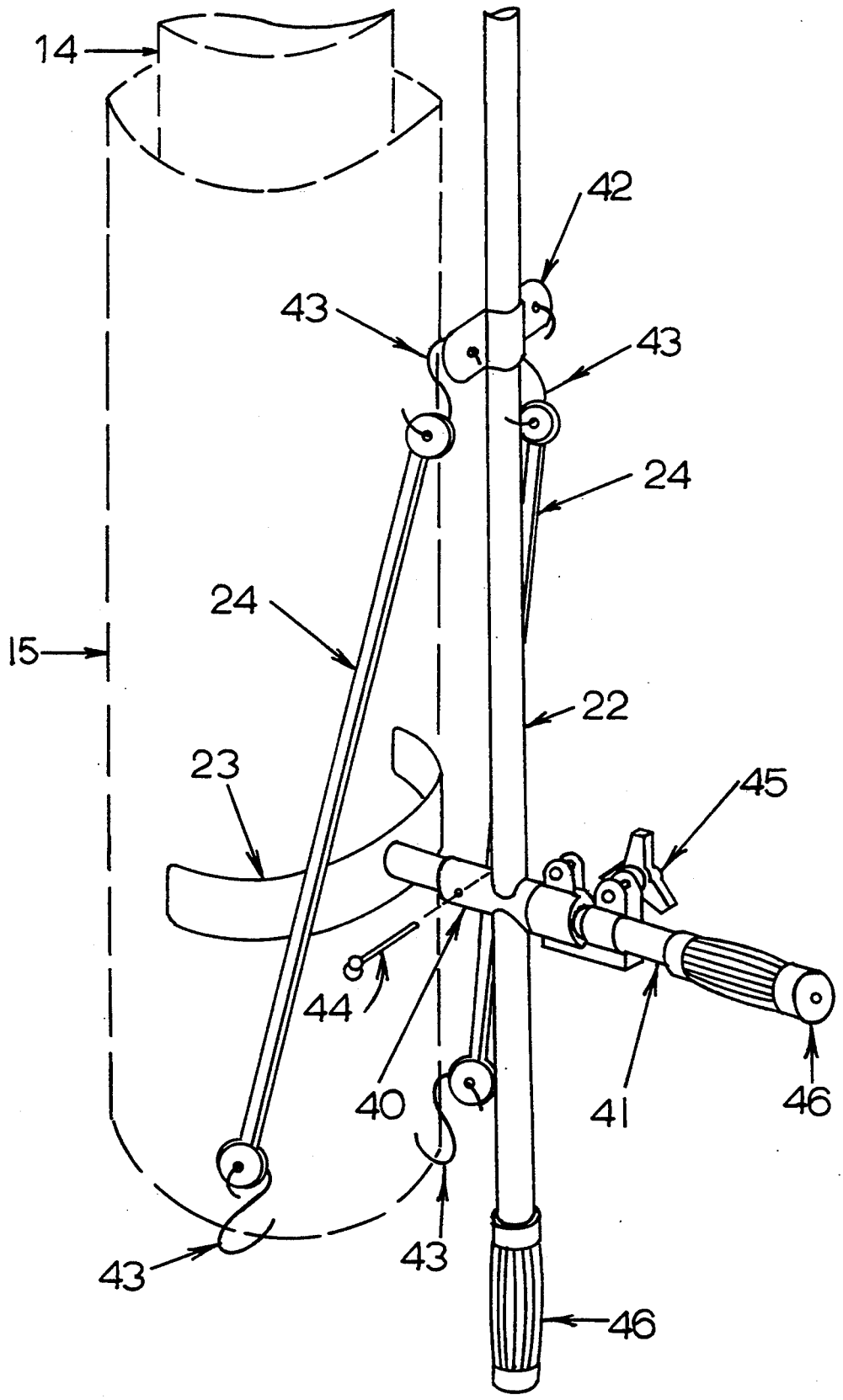
FIG. 5 is a pictorial view of the lower portion of a preferred embodiment showing an adjustable yoke and one means for applying a bending moment.

Referring now to FIG. 1, there is shown in section a vehicle cab, indicated generally at 11, having an engine exhaust manifold 12 that is split into two exhaust stacks 13 and 14 with elbow turn-outs, each having a heat shield 15. (As noted above and illustrated in FIG. 8, the presence of a heat shield is not needed for the use of the device of the invention.) In FIG. 1 a device of the invention has been applied so that no exhaust gases flow through stack 14. (Some diesel vehicles have shorter stacks, as shown by 14A.) All engine fumes flow through stack 13, are captured by exhaust cane 16, and are carried to the building exhaust duct system through flexible hose 18, which is attached to the exhaust cane by nozzle 17. In the embodiment of the invention shown, heat-resistant resilient pad 19 is mounted on plate 20, which is attached to the positioning guide 21, and this assembly, more fully depicted in FIGS. 2, 3, and 4, is mounted on the upper portion of support member 22. Yoke 23, more fully depicted in FIG. 5, is mounted on the lower portion of support member 22. In this depiction, two stretch tension straps 24, only one of which can be seen, have one end fastened to support member 22 and the other end, under tension, hooked to the bottom edge of heat shield 15 to supply a downward and inward (toward the stack) force that places the pad 19 in sealing engagement with the exhaust stack outlet. In the embodiment shown in FIG. 2 the plate and guide assembly is adjustably mounted on the support member so that one device of this design can be used to stopper exhaust stacks of different heights.

The plate and guide assembly of the design of FIG. 1 is shown in more detail in FIG. 2, where the elbow contour bar 25 and the arch 26, which make up positioning guide 21 of FIG. 1, can be seen to aid in positioning pad 19 laterally relative to the stack outlet, as well as allowing the adjustment at the ends of the arch to conform the elbow contour bar to the configuration of the stack turn-out. Adjustable locking means 27, which secures the guide position for adjustment to a particular stack elbow curvature, is more fully depicted in FIG. 3. Tube 28, mounted on the opposite side of plate 20 from the pad and free to slide up and down support member 22, shows one way the plate and guide assembly may be adjusted to stack outlets of different heights. Tabs 34, mounted on the plate, afford one way to attach the assembly to support member 22 or tube 28. Adjustable locking device 29, for example, a cam-twist or drill-through and pin, shows how the vertical position of the plate and guide assembly may be locked in place at the desired height on the support member.

One preferred embodiment of plate and guide assembly, which is particularly adapted to use on exhaust stacks having a curved or angled turn-out and for which the plane of the exhaust outlet is nominally vertical, is shown in FIG. 3. Here the resilient pad 19 is held onto plate 20 by means of a retainer 30, attached to the plate with fasteners 31. Side guides 32, attached to plate 20 by fasteners 33, insure that the plate and positioning means assembly is properly positioned with regard to the stack outlet. Elbow contour bar 25 is affixed to the upper portion of plate 20 and to the center of U-shaped member 26 with fasteners 35. (The cross section of the U-shaped member may vary as described above for the U-shaped member of a yoke.) The free ends of the U-shaped member contain slots 36 through which extend threaded studs 37, which may be mounted on an angle bend of a portion of the plate or on angled tabs affixed to the plate. Wing nuts 38 screw on the studs 37. The U-shaped member may be moved within the constraints of the slots so that the distance between the elbow contour bar and the plate may be adjusted according to the curvature of the stack elbow turn-out, and fixed in place when the wing nuts are tightened. Also shown on FIG. 3 are wire shims 39, mounted between the plate and the upper portion of the pad. The shims serve to keep the pad in sealing engagement with the stack outlet when the downward and inward force tends to pull the pad away from the top of the stack outlet. The top of the pad may be held in place by the elbow contour bar, as shown.

FIG. 4 is a plan view of the assembly shown in FIG. 3. The shims 39 are seen to be curved to conform at least roughly to the curvature of the top of the stack outlet so as to raise the pad to seat firmly against the stack outlet.

FIG. 5 depicts the lower portion of the embodiment shown in FIG. 1. Tube 40 extends through support member 22 permitting the stem portion 41 of yoke 23 to move back and forth through the support member. Bracket 42, which is affixed to support member 22 and is in a plane nominally tangent to the curvature of the heat shield, has two holes, one on each side of support member 22. The two stretch-tension hold-down straps 24 have an S-hook 43 at each end, one S-hook passing through one of the holes in bracket 42 and the S-hook at the other end of the strap hooked under the bottom edge of the heat shield. The straps are under tension so as to apply a downward and inward force to the support member, forcing the resilient pad against the stack outlet in sealing engagement. Alternative methods for securing support member 22 at a selected distance from the heat shield by locking stem 41 in position relative to tube 40 are pin 44, which passes through the tube and through the appropriate one of a series of holes in the stem, and lock-set device 45 for locking the position of the stem in the tube. Grips 46 are for the convenience, protection, and comfort of the operator.

In operation the device will usually be put in place before the engine is started. The operator, having first set the appropriate adjustment for the stack elbow curvature, will bring the pad and positioning means assembly down over the top of the exhaust stack outlet so that the pad is adjacent to the stack outlet, fasten the tension straps in position, and then adjust the distance of the yoke from the center line of the stack so as to press the pad into sealing engagement with the stack outlet. When the engine is started, the operator can check to see whether there is any leakage of exhaust, and if so, adjust the yoke position to eliminate the leak.

Figure 6A:
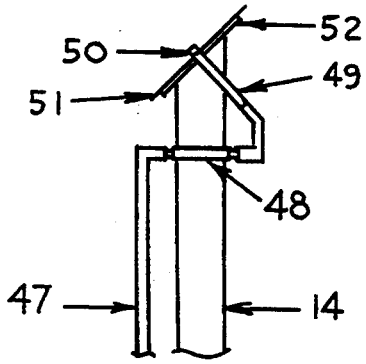
FIG. 6 is a pictorial view of a second preferred embodiment in operation, with a variation shown in FIG. 6A.
Figure 6:
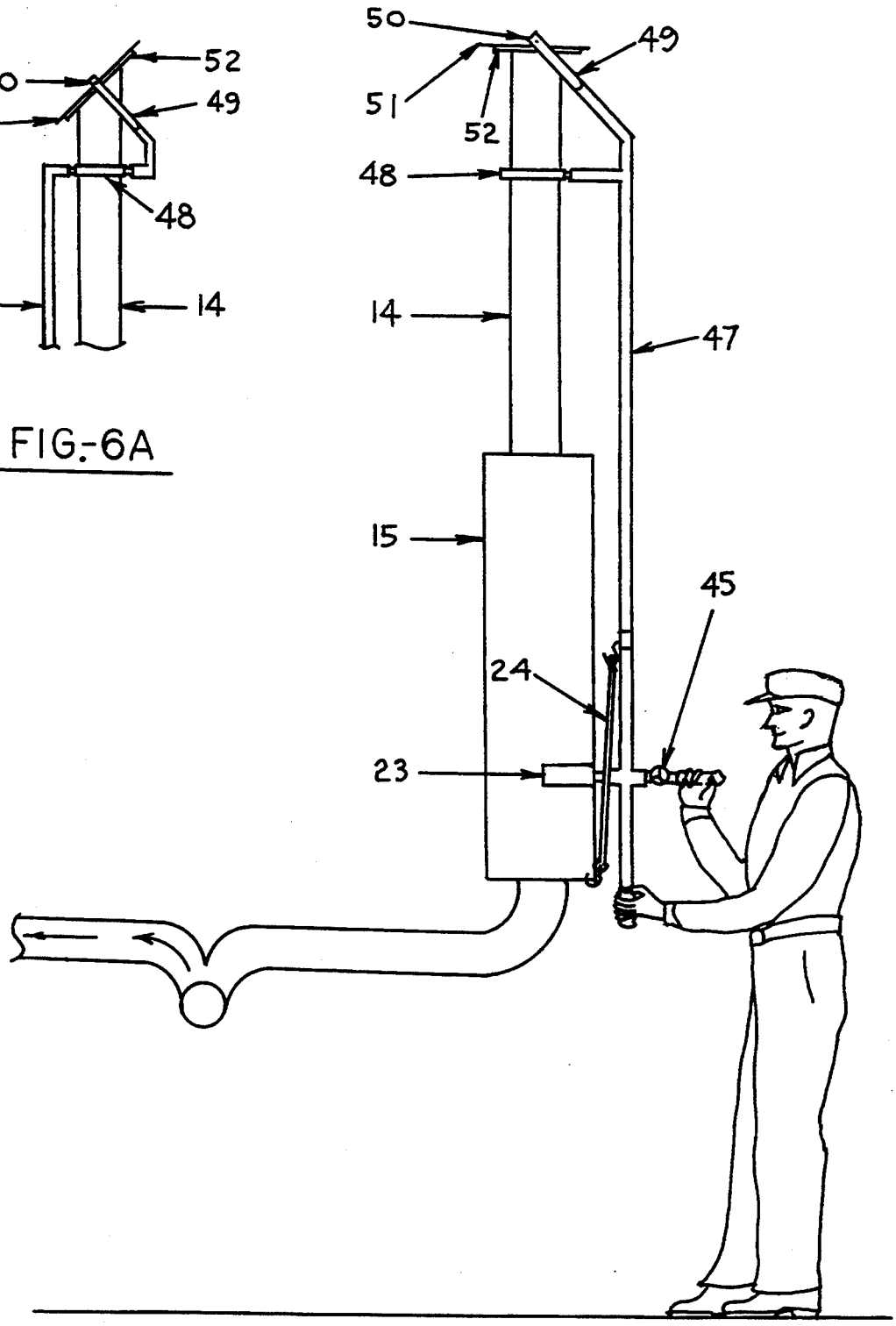

FIG. 6 shows a different preferred embodiment particularly adapted to exhaust stacks having a vertical discharge rather than a turn-out. In FIG. 6 support member 47, which is not offset as is the support member of FIG. 1, has at the lower portion a yoke arrangement similar to that described for FIG. 5. The upper portion has a stem-mounted guide ring 48, which encircles the curvature of the exhaust stack, the stem end of which is attached to the support member to keep the support member at a fixed distance from the stack. The upper portion of the support member above the guide ring is angled toward the stack and ends in a second yoke 49, which is positioned with one end of the open portion on either side of the exhaust stack. Near the two ends of the open end of yoke 49 are pivot holes 50 adapted to be placed over the center line of the exhaust opening. Plate 51, on which is mounted heat-resistant, resilient pad 52, is arranged to pivot on an axle that passes through pivot holes 50, as is more clearly shown in FIG. 7.

FIG. 6A shows a variation of the positioning means of FIG. 6 in which the stem of yoke 49, or an extension of the stem, is attached to the guide ring 48 on the side opposite the attachment of the ring to support member 47. Either the device of FIG. 6 or the variation of FIG. 6A can be used to stop the flow from a flat cut or slant cut outlet. The clearance between the exhaust stack and the tractor cab, as well as the direction of a slant cut outlet, will determine if it is more convenient to use a device with the positioning means on the same side as the support member or on the opposite side.

Figure 7A:
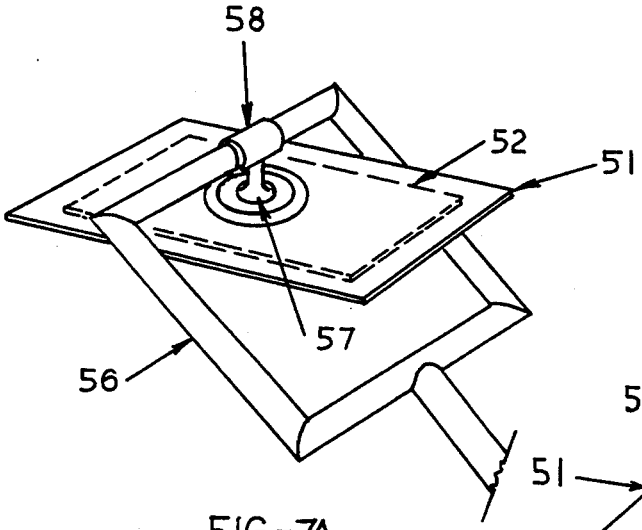
FIG. 7 is a pictorial view showing in detail the top portion of the preferred embodiment of FIG. 6, with a variation shown in FIG. 7A.
Figure 7:
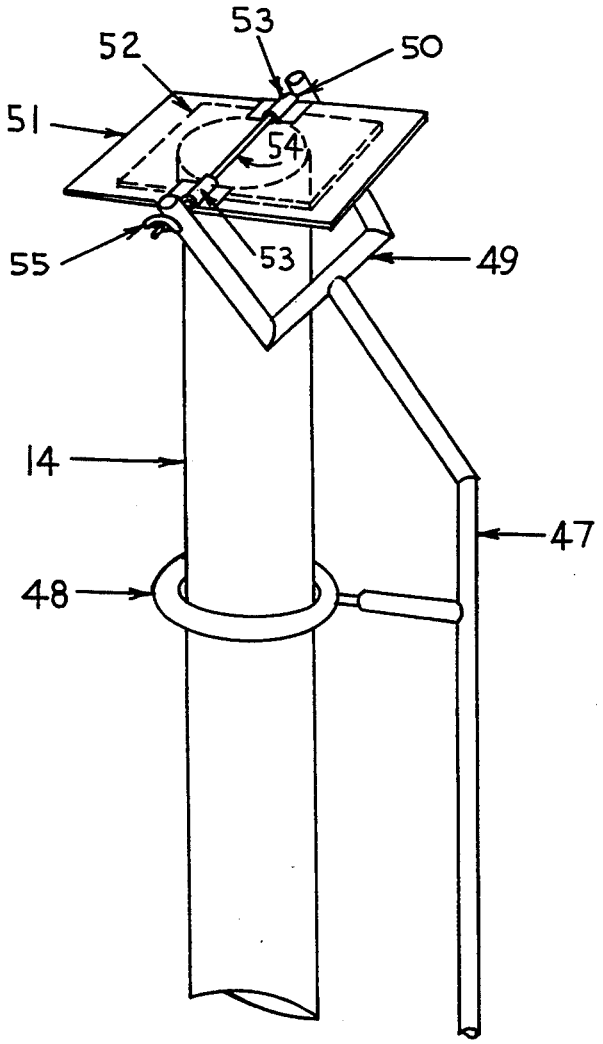

FIG. 7 shows in greater detail the upper portion of the embodiment of FIG. 6. Axle 54 is attached to plate 51 by mountings 53 and passes through the pivot holes 50, ending at one or both ends in a threaded portion on which a wing nut 55 may be tightened to provide sufficient resistance to the rotation of the plate to keep it from moving freely, but not so much that the pad will not seat firmly on the stack outlet when a downward force is applied.

FIG. 7A shows a different manner of adjustably mounting plate 51. Here the U-shaped member of the yoke has been replaced with a rectangular member 56. A ball and socket joint 57 is mounted on the back of plate 51, with the stem of the joint fastened to the rectangular member by mounting 58.

The manner of mounting the pad on the plate is not shown. A variety of possibilities will be evident to those skilled in the art, including high temperature cement, a retaining frame fastened to the plate, or direct attachment with any appropriate fasteners.

Figure 8:
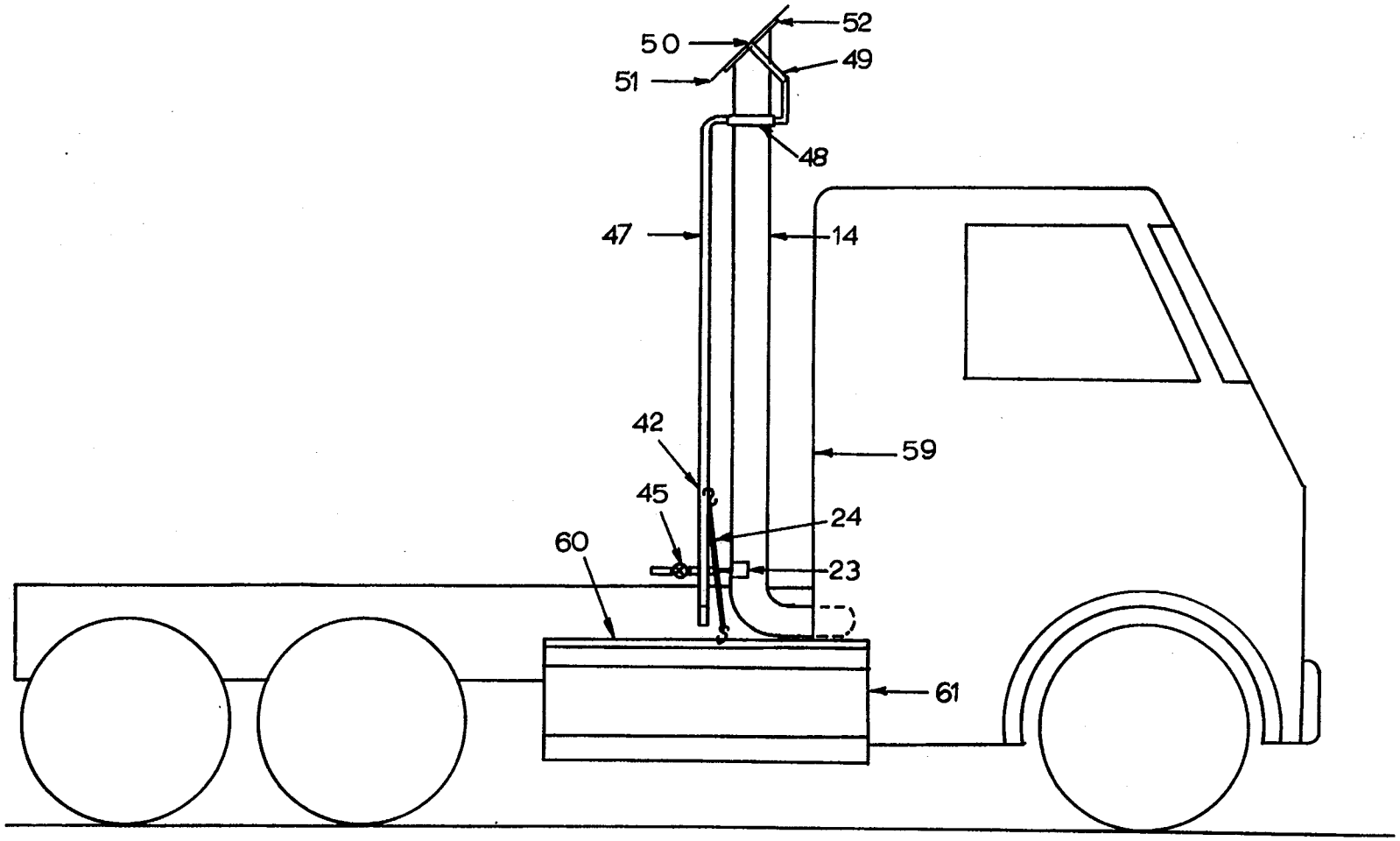
FIG. 8 is a pictorial view showing the device in operation on an exhaust stack not having a heat shield.

FIG. 8 shows the device with the modification of FIG. 6A in use on an exhaust stack without a heat shield, with a tractor cab and body 59 shown in outline. The device of FIG. 8 requires the substitution of a different size yoke 23 to conform to the difference in diameter between the heat shield and the exhaust stack. In FIG. 8 the tension straps 24 are hooked at their lower ends to metal step 60, which is above fuel tank 61. Regardless of how the stack is mounted relative to the cab, there will be available some suitable point of attachment for the lower end of the tension straps or other tensioning means.

Figure 9:
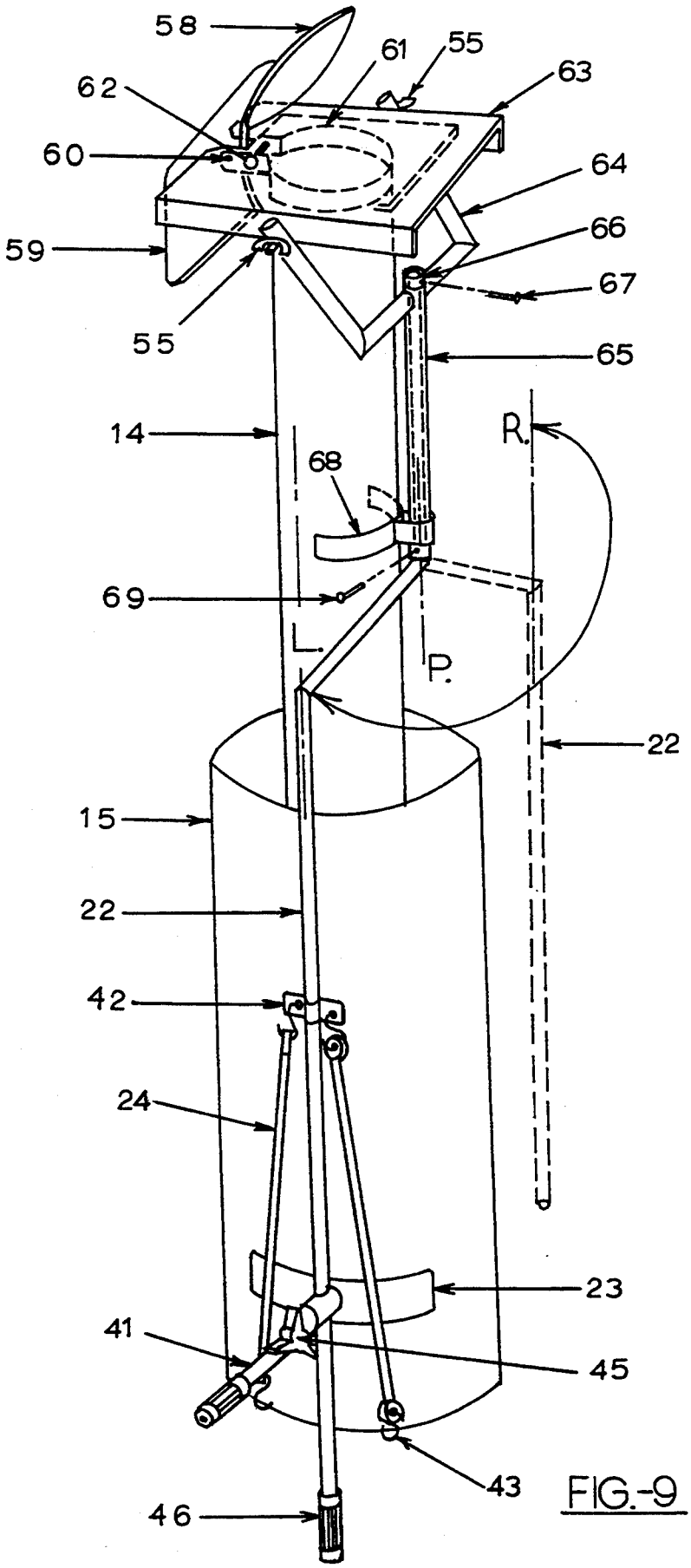
FIG. 9 is a pictorial view of an embodiment especially adapted for use on stacks having a rain cap.

FIG. 9 shows an embodiment of the device especially adapted for use on stacks having a rain cap, but also having features that may be used with other embodiments. The rain cap assembly, made up of rain cap 58 and counterbalance 59, is free to pivot about pivot point 60 of mounting strap 61. The mounting strap is secured at or near the top of the stack with bolt 62. The pad-holding plate and yoke assembly for a stack with a rain cap may be essentially as shown in FIG. 7o However, as shown in FIG. 9 plate 63 has a cutout portion at one end to accommodate the rain cap assembly and to allow the center line of the plate to be placed approximately over the center of the stack outlet. When the stack stopper is being put in place on a stack having a rain cap, the plate will lift up the front edge of the rain cap, which overhangs the stack, and slide in underneath the cap to cover the stack outlet.

Plate 63 also differs from plate 50 of FIG. 7 in having the two sides that pass through yoke 64 turned down, with attachment of the plate to the yoke by means of a wing nut 55 on a short bolt on each side of the plate instead of by an axle such as 54. Of course a plate such as 63, with or without the cutout, may be used on stacks without a rain cap, such as those shown in FIGS. 6 and 7.

FIG. 9 also shows a different method of mounting the yoke on the support member. Yoke 64 is attached to tube 65, which has an inner diameter such that tube 65 can rotate about support member 22. As depicted the lower end of tube 65 rests on the offset of the support member. Above the upper end of the tube a removable bearing collar 66 is held on the support member by a locking pin 67, which passes through the collar and the support member. It is apparent that for a support member without an offset, a similar bearing collar fastened on the support member could be used to support the tube. FIG. 9 also shows another yoke 68 attached toward the lower end of tube 65 and conforming to the curvature of the stack. Yoke 68 serves to steady the whole assembly and assist in positioning the pad-bearing plate.

Another feature of the embodiment of FIG. 9 is the capability of changing the plane of the offset support member relative to the plane of yoke 64. Two positions, right (R.) and left (L.) are shown for the support member, which can pivot about pivot axis P. Holes through tube 65 correspond to the left and right positions, and either set of holes can be aligned with a hole through the support member and held in the chosen position by means of locking pin 69. When the clearance between the tractor cab and the heat shield is not sufficient for proper positioning of yoke 23 and the associated tensioning assembly in one alignment of tube 65 and the support member, the alignment may be changed so that the clearance is no longer an impediment to use of the stack stopper. Alternative means for fixing the position of tube 65 relative to support member 22 will be apparent to those skilled in the art.

It is apparent that the attachment of the yoke and plate assembly to tube 65 in the manner shown permits the entire yoke, plate, and tube to be removed from the support member. It is also apparent that the pad-bearing plate assemblies of FIGS. 3, 6, and 7 could also be mounted on a removable tube such as 65, rather than being firmly fastened to a support member, so that they all could be used interchangeably on one support member or be placed on the stack by alternative means.

One material suitable for use as the heat-resistant, resilient pad is silicone rubber sheet compounded to be heat resistant to 600° F. Such materials are articles of commerce and are available from West American Rubber Company and Jedco, Inc. Pads fashioned from ¼ inch sheet having durometer readings of 50 and 70 have been found to be useful, with the more resilient 50 durometer pad being preferred. It is expected that any material having similar heat-resistance and resiliency will be satisfactory.

It is apparent that many variations from the particular embodiments exemplified above can be made without departing from the spirit of the present invention. In particular, various means for guiding, adjusting, and locking the position of the pad or for adjusting and locking the yoke relative to the heat shield or lower portion of the stack will be apparent to those skilled in the art. Similarly, other means of applying tension to the support member, such as springs or an arrangement of turnbuckles, are within the scope of the present invention, as are alternative means for varying the height of the plate and pad assembly relative to the heat shield yoke, e.g., at least a portion of the support member may be telescoping with means for locking in the desired position. Also, although the support member has been shown as being parallel to the exhaust stack and heat shield, whether offset or not, other configurations of the support member are possible, if perhaps not as convenient. While the embodiment shown in FIG. 1 has the position of the pad and plate assembly adjustable, in some applications this feature may not be required. For example, for a fleet of vehicles all having the same stack height, the pad and plate assembly could be in a fixed position with some saving in the cost of making the device.

What I claim is:

1. A device for shutting off the flow of exhaust gases from one of the exhaust outlets of a diesel engine having two substantially vertical exhaust stacks leading from a single engine exhaust manifold which comprises:

a) a heat-resistant, resilient pad larger than the exhaust stack outlet;

b) a plate having a top, a bottom, a front, a back, and two sides, on the front of which is mounted the pad;

c) positioning means for holding the plate;

d) means for applying to the device a downward force that holds the pad in sealing engagement with the exhaust stack outlet so as to shut off the flow of exhaust gases from that exhaust stack.

2. A device of claim 1 mounted on the upper portion of a generally vertical support member having an upper and lower portion, the downward force being applied to the support member.

3. A device of claim 2 having distancing means mounted on the lower portion of the support member for maintaining the distance between the exhaust stack and the support member.

4. A device of claim 3 in which the positioning means adjusts to the cutoff angle of the exhaust outlet and may be positioned at different heights on the support member.

5. A device of claim 4 in which the distancing means may be adjusted to maintain the distance between the exhaust stack and the support member at a selected position.

6. A device of claim 5 in which the distancing means is a generally Y-shaped yoke consisting of a U-shaped member and a stem with the concave side of the U-shaped member facing the exhaust stack and the free end of the stem adjustably mounted on the support member, 7. A device of claim 1, for use on an exhaust stack having a turn-out and a substantially vertical outlet, in which the positioning means consists of a curved strap having a top and a bottom and a U-shaped member having a center and two ends, the top of the curved strap being fastened to the top of the plate and the bottom to the center of the U-shaped member with the concave side of the U-shaped member facing the plate and two ends adjustably fastened, one on each side of the bottom of the plate.

8. A device of claim 7 mounted on the upper portion of a generally vertical support member having an upper and lower portion, the downward force being applied to the support member.

9. A device of claim 8 having distancing means mounted on the lower portion of the support member for maintaining the distance between the exhaust stack and the support member.

10. A device of claim 9 in which the distancing means may be adjusted to maintain the distance between the exhaust stack and the support member at a selected position.

11. A device of claim 10 in which the distancing means is a generally Y-shaped yoke consisting of a U-shaped member and a stem with the concave side of the U-shaped member facing the exhaust stack and the free end of the stem adjustably mounted on the support member.

12. A device of claim 1 for use on an exhaust stack venting straight up in which the positioning means consists of a) a generally Y-shaped yoke consisting of a U-shaped member and a stem and having a hole near each end of the U-shaped member with the holes in the yoke adapted to be placed one on each side of the exhaust outlet and on an axis over the center line and in the plane of the exhaust outlet;

b) means for attaching the plate to the yoke holes so that the plate may rotate about the axis of the yoke holes;

c) means for applying resistance to the free rotation of the plate.

13. A device of claim 12 in which the free end of the stem is mounted on the upper portion of a generally vertical support member having an upper and lower portion, the downward force being applied to the support member.

14. A device of claim 13 having a guide ring with an inner diameter enough larger than the outer diameter of an exhaust stack having a vertical outlet so that the ring may be placed over and slide down around the stack and a stem having two ends, one attached to the guide ring and the other mounted on the support member below the yoke holding the plate.

15. A device of claim 14 having distancing means mounted on the lower portion of the support member for maintaining the distance between the exhaust stack and the support member.

16. A device of claim 15 in which the positioning means adjusts to the cutoff angle of the exhaust outlet and may be positioned at different heights on the support member.

17. A device of claim 16 in which the distancing means may be adjusted to maintain the distance between the exhaust stack and the support member at a selected position.

18. A device of claim 17 in which the distancing means is a generally Y-shaped yoke consisting of a U-shaped member and a stem with the concave side of the U-shaped member facing the exhaust stack and the free end of the stem adjustably mounted on the support member.

19. A device of claim 7 for use on an exhaust stack having a heat shield concentric with the exhaust stack in which the upper portion of the support member is substantially parallel to the exhaust stack, the lower portion is substantially parallel to the heat shield, and the concave side of the U-shaped member of the yoke conforms to the curvature of the heat shield.

20. A device of claim 7 having at least one shim between the pad and the plate to aid in sealing engagement of the pad with the exhaust stack outlet.

* * * * *